US007988359B1

(12) United States Patent
Sussman et al.

(10) Patent No.: US 7,988,359 B1
(45) Date of Patent: Aug. 2, 2011

(54) CLOSEABLE FOOD BAG

(76) Inventors: Gordon Sussman, New York, NY (US); Tang Suk Man, Hong Kong (HK)

( * ) Notice: Subject to any disclaimer, the term of this patent is extended or adjusted under 35 U.S.C. 154(b) by 600 days.

(21) Appl. No.: 12/069,920

(22) Filed: Feb. 12, 2008

(51) Int. Cl.

| | |
|---|---|
| ***B65D 33/10*** | (2006.01) |
| ***B65D 33/06*** | (2006.01) |
| ***B65D 30/16*** | (2006.01) |
| ***B65D 30/08*** | (2006.01) |
| ***B65D 30/20*** | (2006.01) |

(52) U.S. Cl. ..... 383/10; 383/14; 383/63; 383/64; 383/66; 383/104; 383/116; 383/120

(58) Field of Classification Search ..... 383/10, 383/63, 64, 104, 116, 120, 66, 14, 62, 65
See application file for complete search history.

(56) References Cited

U.S. PATENT DOCUMENTS

| | | | | |
|---|---|---|---|---|
| 4,615,045 | A | 9/1986 | Siegel | |
| 5,480,230 | A * | 1/1996 | May | 383/9 |
| 6,360,513 | B1 | 3/2002 | Strand | |
| 6,361,209 | B1 * | 3/2002 | LaRue et al. | 383/10 |
| 6,712,510 | B2 | 3/2004 | Schneider | |
| 6,874,935 | B2 * | 4/2005 | Edelman et al. | 383/5 |
| 2006/0188177 | A1 | 8/2006 | Dyer | |
| 2006/0204148 | A1 | 9/2006 | Kohn | |

FOREIGN PATENT DOCUMENTS

| | | | |
|---|---|---|---|
| JP | 2001213451 A | * | 8/2001 |
| JP | 2005231677 A | * | 9/2005 |
| JP | 2008265826 A | * | 11/2008 |

OTHER PUBLICATIONS

Machine translation of JP 2005231677 A. Translated on Sep. 11, 2010.*

* cited by examiner

*Primary Examiner* — Jes F Pascua
(74) *Attorney, Agent, or Firm* — James A. Quinton

(57) ABSTRACT

The bag has a back panel, a front panel, an upper panel having an upper panel body and a flap and a floor panel. The back panel has a handle opening near the top of the panel. The front panel is shorter than the back panel and is connected to the back panel at the sides of the panel. The upper panel body is sealed to the back panel below the back panel handle, below the upper panel handle and above the flap fold line to form a bag top. The heat sealing desirably forms a seal strip that extends across the width of the bag below the handles and above the flap fold line to connect the upper panel body to the back panel. The top of the bag folds back away from the bag central opening so the handles are not soiled during loading.

14 Claims, 6 Drawing Sheets

CLOSEABLE FOOD BAG

FIELD OF THE INVENTION

The field of the invention is plastic bags for takeout food.

BACKGROUND OF THE INVENTION

Convenience cooked products have become popular with the general public. Rotisserie or roasted chickens have become a successful product for supermarkets and other convenience outlets. However the packaging has been problematical.

The packaging for cooked chicken needs to open and close easily and securely. Such packaging should be easy to load without contaminating the outside of the packaging.

Numerous plastic bags for food products are known. See U.S. Pat. No. 4,615,045 (Siegel), U.S. Pat. No. 6,712,510 (Schneider), US2006/0188177 (Dyer), US2006/0204148 (Kohn); U.S. Pat. No. 6,360,513 (Strand). There is still a need in the art for improved takeout bags.

SUMMARY OF THE INVENTION

According to the invention, a plastic bag for carryout food and a method of making such a bag are provided. The bag has a back panel having a top and bottom, a front panel, an upper panel having an upper panel body and a flap and a floor panel. The back panel has a handle opening near the top of the panel. The front panel is shorter than the back panel and is connected to the back panel at the sides of the panels. The front panel terminates below the back panel handle. The floor panel connects the front and back panels at the bottom.

The upper panel body has a handle opening near its top. The bottom of the upper panel is folded a preselected distance upwardly from the bottom of the upper panel along a fold line to form a flap at least partially overlapping the upper panel body at the bottom. Thus the upper panel is composed of a flap and a upper panel body. The upper panel body is heat sealed to the back panel below the back panel handle, below the upper panel handle and above the flap fold line to form a bag top. The heat sealing desirably forms a seal strip that extends horizontally across the width of the bag below the handles and above the flap fold line to securely connect the upper panel body to the back panel. The upper panel handle is located in the top of upper panel body so that there is substantial alignment of the upper panel and back panel handles when the bag is assembled.

The front panel and the back panel are heat sealed together at the sides thereof. The upper panel body is heat sealed to the back panel at the sides thereof. The flap is heat sealed to the front panel at the sides. As a result, a bag is formed having a large central opening for loading of a food product therein. The resulting takeout bag has two handles which are independently attached to the bag on the same side of the central opening. The top of the bag which includes the handles folds back away from the central opening so the handles are not soiled during loading. The opening extends practically the entire width of the bag to provide a wide opening for loading a hot food particularly a rotisserie or roasted chicken.

An interlocking closure is provided to tightly seal the central opening after loading with food. The closure desirably has a first track and a second track that interlocks with the first track. The first track is mounted to the outside of the flap of the upper panel. The second track is mounted to the inside of the front panel. When the tracks are engaged, the central opening is sealed. When the tracks are disengaged, the central opening is opened.

The resulting bag can be quickly loaded without soiling the top of the bag which folds away from the opening. The handles are formed in separate bag panels. This results in a stronger handle structure. As a result one handle can fail without compromising the integrity of the bag. Since the handles are attached to different panels than the closure system, any ripping of the top at the handles will not affect the seal. The seal strip separates the handles structurally from the rest of the bag. Any ripping in the top of the bag would likely not migrate past the seal strip to the bag. As a result, the bag will remain sealed despite handle failure.

In another aspect of the invention, a method of forming a plastic bag for carryout food is provided. A plastic back panel is formed having a top and bottom by cutting plastic film. A plastic front panel having a top and bottom is also cut. A floor panel is cut desirably folded to form a gusset and placed between the front panel and back panels at the bottom of the front and back panels. The floor panel is then heat sealed to the front and back panels to form a bag floor. The top of the front panel terminates below the top of the back panel so the front panel will not cover a handle cut or punched in the top of the back panel. An upper panel having a top and bottom is desirably cut. The upper panel side that faces the front panel is not heat sealable to itself. The bottom of the upper panel is folded upward a preselected distance along a fold line to form a flap at the bottom of the upper panel. The upper panel has two sections, the flap and the upper panel body which extends from the flap fold line of the flap to the top of the upper panel. The flap extends upwardly a preselected distance from the bottom of the upper panel body to at least partially overlap the upper panel body at the bottom but below the top of the upper panel a sufficient distance that it does not cover a handle punched in the upper handle. The upper panel is then placed between the front panel and the back panel while aligning the flap with the top of the front panel.

An interlocked closure assembly having a first track and a second track is placed between the flap and the front panel. A heat sealing bar is then contacted to the upper portion of the front panel adjacent the track assembly to simultaneously heat seal:

i) the first track to the front panel and the second track to the flap and ii) the upper panel body to the back panel along a substantially horizontal seal strip that extend substantially the entire width of said bag without heat sealing the flap to the upper panel body.

A heat sealing bar is then applied to the sides of the bag to simultaneously heat seal individually on each side:

i) the side of the front panel to side of the back panel;

ii) the side of the upper panel body to the side of the back panel;

iii) the side of the flap to the side of the front panel without connecting the side of the flap to the upper panel body.

Handle openings are then punched in the upper panel body and the back panel above the seal strip.

The resulting bag has an opening extending substantially the entire width of said bag. The resulting bag can be quickly loaded without soiling the top of the bag which folds away from the opening. The handles are formed in separate bag panels. This results in a stronger handle structure. As a result one handle can fail without compromising the integrity of the bag. Since the handles are attached to different panels than the closure system, any ripping of the top at the handles will not affect the seal. The seal strip separates the handles structurally from the rest of the bag. Any ripping in the top of the bag would likely not migrate to the bag below the seal strip. As a result, the bag will remain sealed despite handle failure.

The preferred embodiment of the present invention is illustrated in the drawings and examples. However, it should be expressly, understood that the present invention should not be limited solely to the illustrative embodiment.

DETAILED DESCRIPTION OF THE INVENTION

Figure 1:
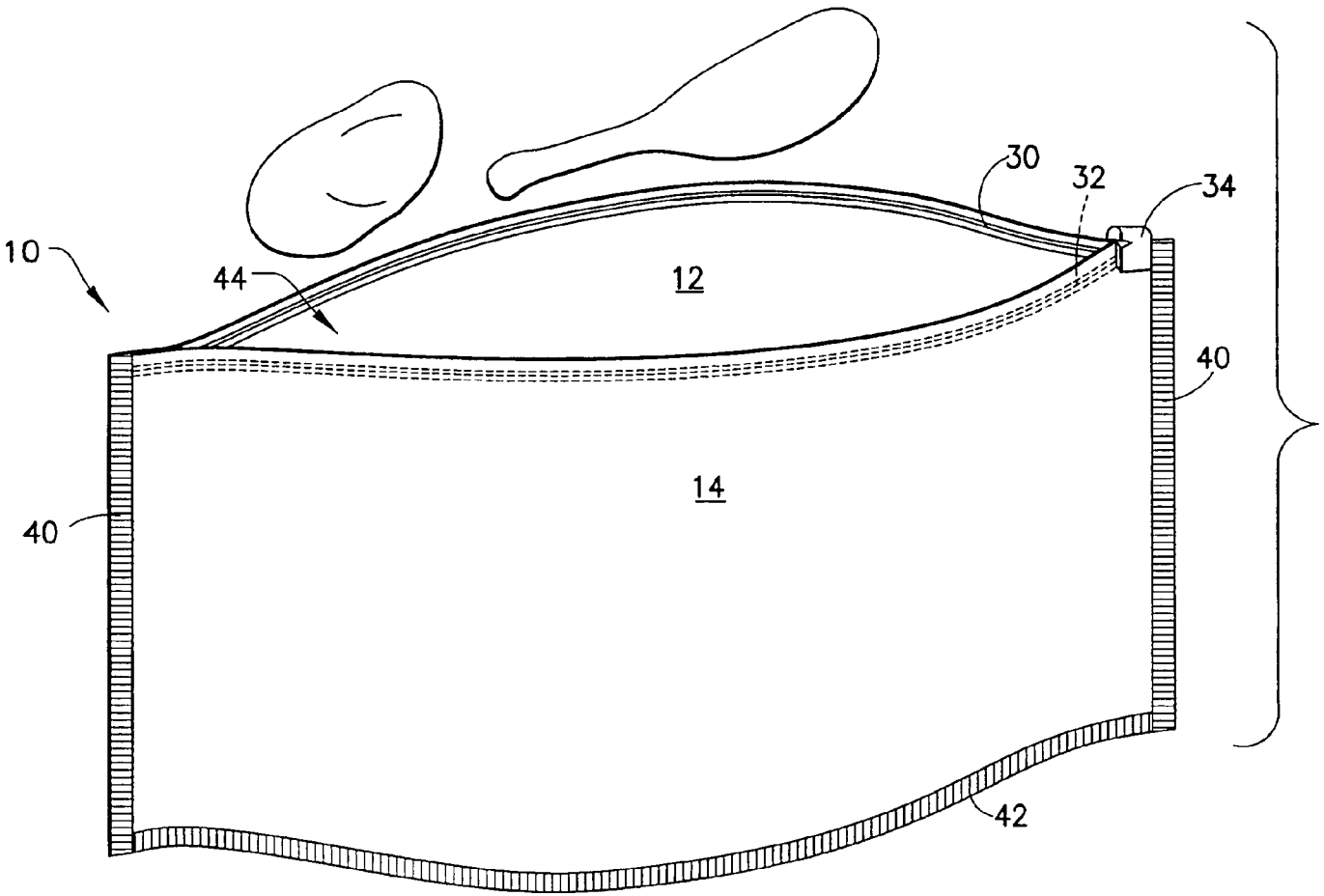
FIG. 1 is a perspective view of a bag according to the invention looking from the front of the bag.
Figure 2:
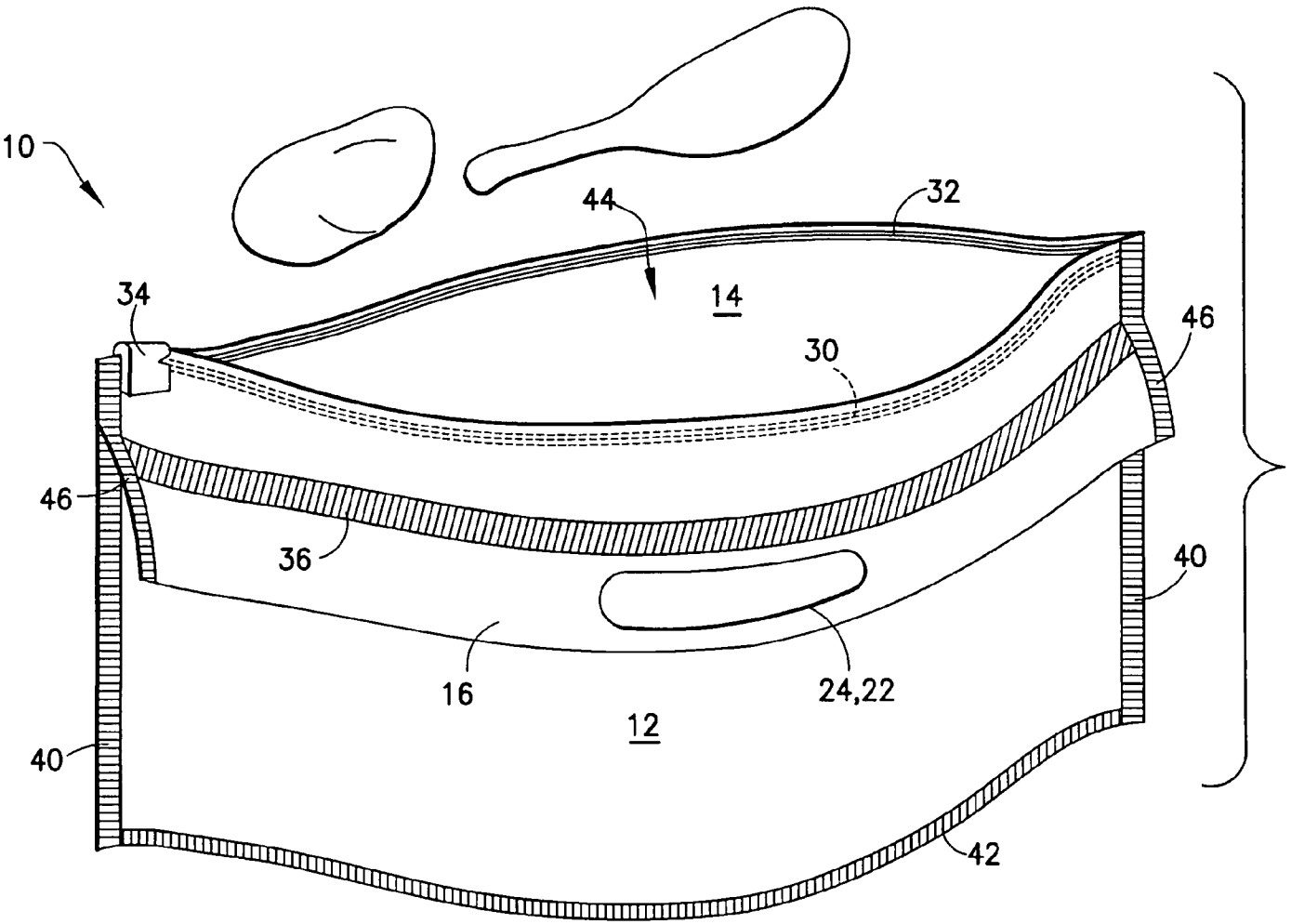
FIG. 2 is a perspective view of a bag according to the invention looking from the back of the bag.
Figure 3:
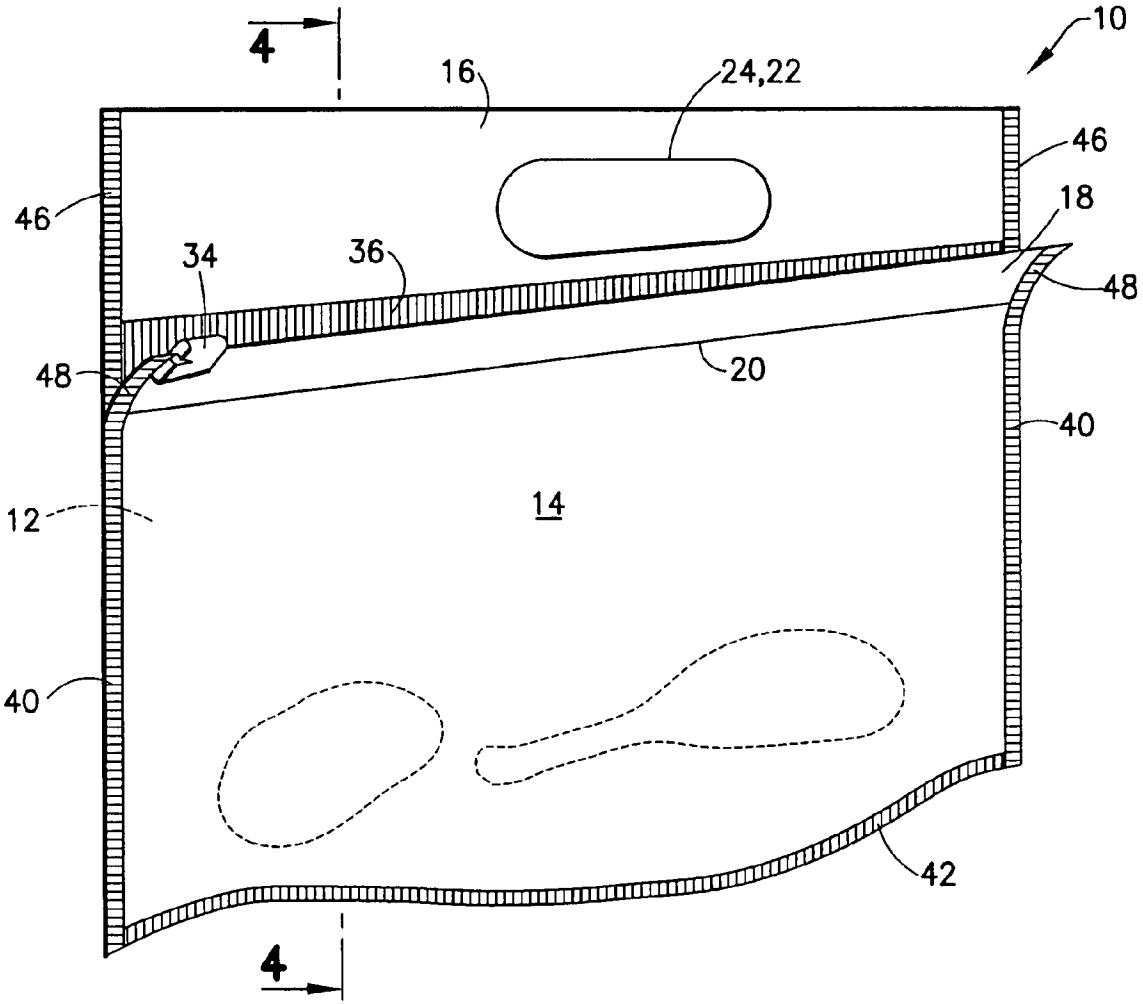
FIG. 3 is a perspective view of a bag according to the invention looking from the front of the bag with the top of the bag in the carrying position.

According to the invention, a plastic bag for carryout food is provided. A method of making a plastic bag for carryout food preferably hot carryout food is also provided. The bag has a back panel having a top and bottom, a front panel, an upper panel having an upper panel body and a flap, and a floor panel. The back panel has a handle opening near the top of the panel. The back panel is desirably a plastic desirably a clear plastic film desirably 20 μm to 50 μm preferably 30 μm of oriented polypropylene (OPP) laminated to 20 μm to 50 μm preferably 40 μm of polyethylene with an optional antifog additive.

The front panel is shorter than the back panel and is connected to the back panel at the sides of the panels. Preferably the front and back panels are heat sealed together at the sides to provide a leak proof side seal. The front panel terminates below the back panel handle. The front panel is a plastic desirably a clear plastic film desirably 20 μm to 50 μm preferably 30 μm of oriented polypropylene (OPP) laminated to 20 μm to 50 μm preferably 40 μm of polyethylene (PE) with an antifog additive. Desirably, the PE sides of the front panel and the back panel face one another and the OPP sides face the outside.

The floor panel connects the front and back panels at the bottom. Desirably the floor panel is composed of a three part plastic laminate composed of chlorinated polypropylene (CPP) outer layers and a nylon middle layer. Preferably the floor panel is a gusset which when extended will allow the bag to stand on a flat surface without tipping over.

An upper panel having a handle opening near its top is provided. The upper panel is divided into two sections, an upper panel body and a flap. The upper panel is desirably a plastic desirably 20 μm to 50 μm preferably 30 μm of oriented polypropylene laminated with desirably 20 μm to 50 μm preferably 40 μm of polyethylene. Optionally, the back, front and upper panels can include printing of logos and/or instructions for usage or other messages.

The bottom of the upper panel is folded a preselected distance upwardly from the bottom of the upper panel to form a flap at least partially overlapping the bottom of the upper panel body. Desirably, the side of the upper panel facing the front panel is composed of a plastic such as an OPP that will not heat seal to itself. As a result, the flap will not heat seal to the upper panel body during manufacture. The upper panel body is heat sealed to the back panel below the back panel handle and below the upper panel handle and above the fold line of the flap to form the bag top. The heat sealing desirably forms a seal strip that extends horizontally across the width of the bag below the handles and above the flap fold line to securely connect the upper panel body to the back panel. The front panel and the back panel are heat sealed together at the sides thereof. The upper panel body is heat sealed to the back panel at the sides thereof. The flap is heat sealed to the front panel at the sides thereof. The flap is not heat sealed to the upper panel body. As a result a bag is formed having a large central opening for loading of a food product therein. The upper panel handle is located in the upper portion of the upper panel body so that there is substantial alignment of the upper panel and back panel handles when the bag is assembled.

An interlocking closure is provided to tightly seal the central opening after loading with food. The closure desirably has a first track and a second track that interlocks with the first track. The first track is mounted to the outside of the flap of the upper panel. The second track is mounted to the inside of the front panel. When the tracks are interlocked, the central opening is sealed. Desirably, the tracks are of the zipper track type desirably a plastic zipper track preferably polyethylene with a slider to engage and disengage the tracks. When the tracks are disengaged, the central opening is opened. Desirably, the bag top folds below the seal strip desirably along the flap fold line downward away from the opening so that contamination of the bag top and handles during food loading of said bag can be avoided.

Figure 6:
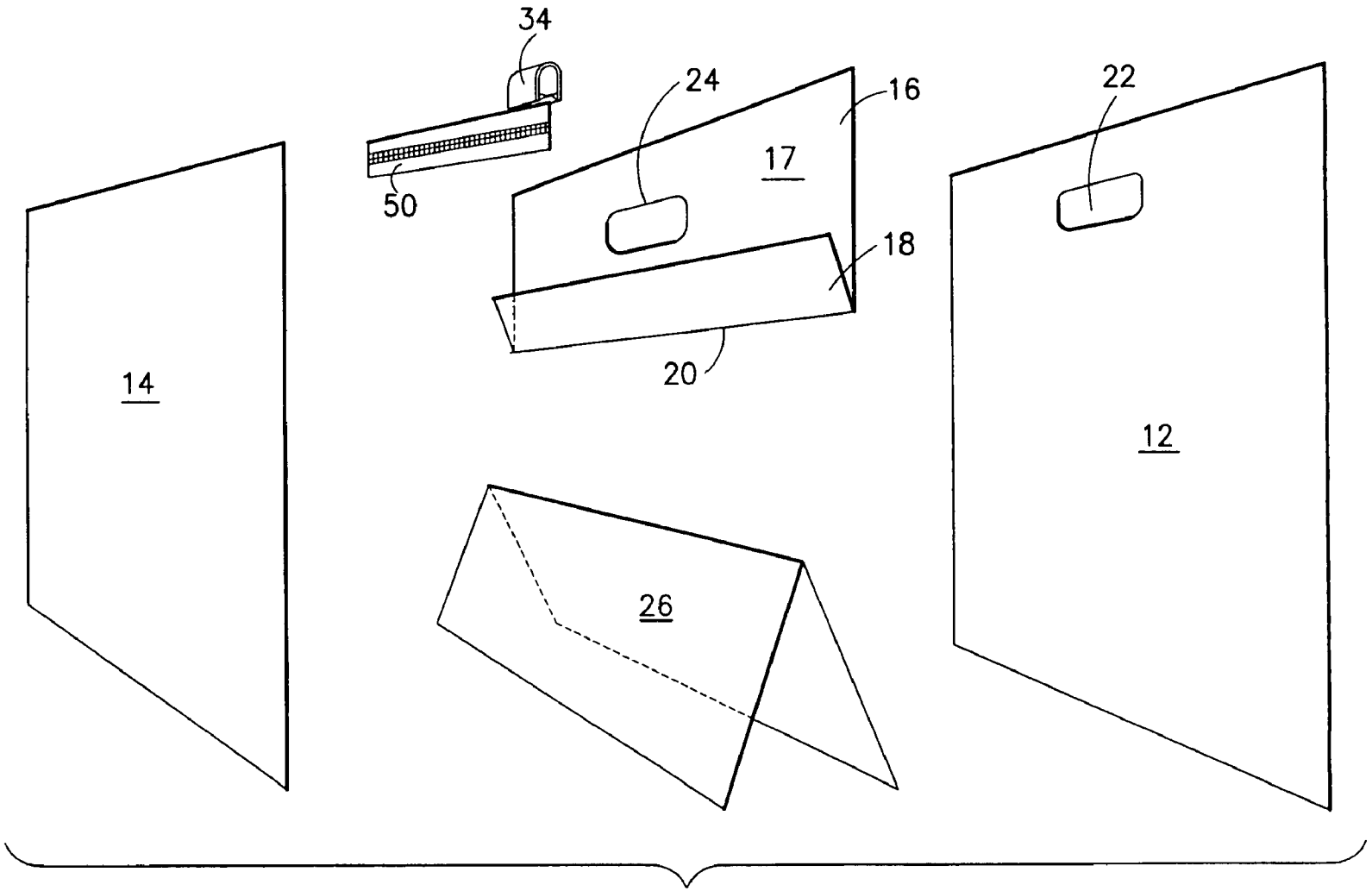
FIG. 6 is a view of the bag components prior to assembly according to the invention.

As best seen in FIGS. 1 to 7, a plastic bag 10 for takeout food preferably hot takeout food desirably for hot rotisserie or roasted chickens is provided. The bag is desirably constructed from components by heat sealing plastic components together. As best seen in FIG. 6, the principal components that are assembled to form the bag 10 are a back panel 12, having a top and bottom, a front panel 14, an upper panel 16 and a floor panel preferably a gusset 26 and a interlocking track assembly 50. The upper panel is composed of an upper panel body 17 and a flap 18. The back panel 12 has a handle opening 22 near the top of the panel which is desirably punched in the bag during its assembly. A vent not shown can be optionally punched in front and/or back panel near the top. The back panel 12 is desirably a plastic more desirably a clear plastic film or sheet desirably 20 μm to 50 μm preferably 30 μm of oriented polypropylene laminated to desirably 20 μm to 50 μm preferably of 40 μm polyethylene with an antifog additive.

Referring to FIGS. 1 to 7, the front panel 14 is shorter than the back panel and is connected to the back panel at the sides of the panels by side seals 40. Preferably the front and back panels are heat sealed together at the sides to provide leak resistant side seals. The front panel 14 terminates below the back panel handle 22. The front panel is a plastic desirably a clear plastic desirably 20 μm to 50 μm preferably 30 μm of oriented polypropylene (OPP) laminated to 40 μm polyethylene (PE) with an antifog additive.

Figure 4:
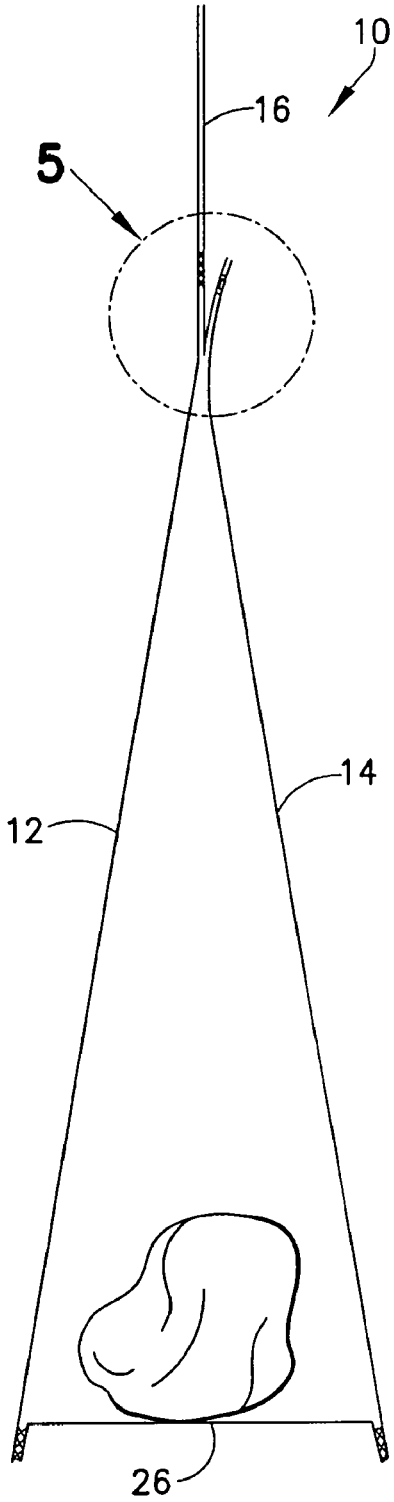
FIG. 4 is a sectional view through 4-4 of FIG. 3.
Figure 5:
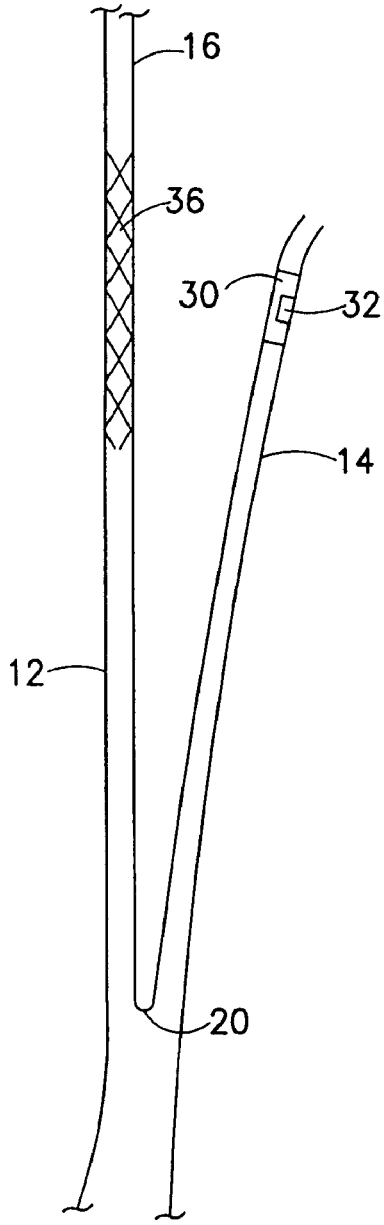
FIG. 5 is a detailed view of area 5 of FIG. 4.

The floor panel preferably gusset 26 connects the front 14 and back 12 panels at the bottom preferably by bottom heat seals 42. Desirably the floor panel 26 is composed of a three part plastic laminate composed of chlorinated polypropylene (CPP) outer layers and a nylon middle layer. As best seen in FIG. 4, the bag 10 stands upright preferably on a flat surface without tipping over when the gusset is unfolded to provide a flat floor.

An upper panel 16 having a handle opening 24 near its top is provided. The upper panel 16 is desirably a plastic desirably 20 μm to 50 μm preferably 30 μm of oriented polypropylene laminated to desirably 20 μm to 50 μm preferably 40 μm of polyethylene. Desirably, the back, front and upper panels can include printing of logos and/or instructions for usage or other messages. The bottom of the upper panel is folded along a fold line 20 a preselected distance upwardly from the bottom of the upper panel body 17 to form a flap 18 at least partially overlapping the upper panel body 17 at the bottom. The flap terminates below the handle opening in the upper panel body 17. The upper panel body 17 is connected preferably heat sealed to the back panel below the back panel handle 22 and below the upper panel handle 24 and above the fold line 20 of the flap 18. The heat sealing desirably forms a seal strip 36 that extends horizontally across the width of the bag below the handle openings 22 and 24 and above the flap fold line 20 to securely connect the upper panel 16 to the back panel 12. The seal strip 36 structurally separates the handles 22 and 24 from the rest of the bag. The front panel and the back panel are heat sealed together at the sides thereof to form side seals 40. The upper panel body is heat sealed to the back panel 12 at the sides thereof to form side seals 46. The flap 18 is heat sealed to the front panel 14 at the sides thereof to form side seals 48. As a result, a bag 10 having a large central opening 44 that extends substantially the entire width of the bag 10 for loading of a food product therein is provided. The upper panel handle opening 22 is located in the upper portion of the upper panel 24 so that there is substantial alignment with the back panel handle opening when the assembled bag 10 is in use.

An interlocking closure system preferably a zipper type closure system 50 desirably having polypropylene (PE) tracks is provided to tightly seal the central opening after loading with food. The closure desirably has a first track and a second track that interlocks with the first track. The first track 30 is mounted to the outside of the flap 18 of the upper panel preferably by heat sealing. The second track 32 is mounted to the inside of the front panel 14 preferably by heat sealing. When the tracks are interlocked, the central opening 44 is sealed. When the tracks are disengaged, the central opening 44 is opened. Desirably, the bag top folds downward away from the opening so that contamination during food loading of the bag can be avoided. A slide 34 is mounted to the tracks to engage and disengage the tracks thereby opening and closing the bag.

The resulting takeout bag has two handles which are independently attached to the bag on the same side of the opening. The top of the bag which includes the handles folds back away from the central opening and behind the back panel 12 desirably below the seal strip 36 preferably along the fold line 20 so the handles 22 and 24 are not soiled during loading. The opening 44 extends practically the entire width of the bag to provide a wide opening for loading a hot food particularly a rotisserie or roasted chicken.

The resulting bag can be quickly loaded without soiling the bag top that folds away from the opening. The handles are formed in separate bag panels. This results in a stronger handle structure. As a result one handle can fail without compromising the integrity of the bag. Since the handles are attached to different panels than the closure system, any ripping of the top at the handles will not affect the seal. The seal strip prevents any rips in the handles from migrating below the seal strip and affecting the integrity of the seal.

Figure 7:
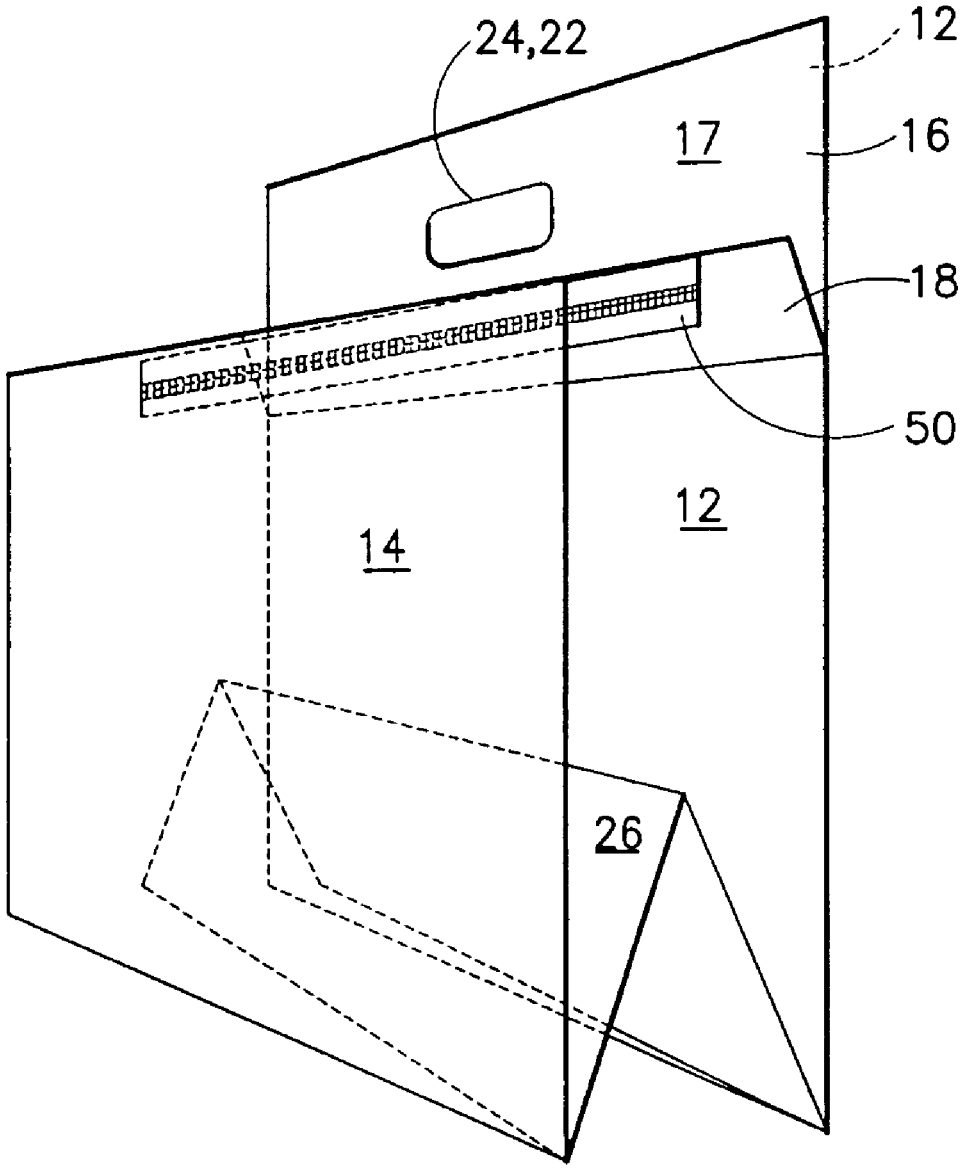
FIG. 7 a view of the bag components in place prior to heat sealing according to the invention.

In another aspect of the invention, a method of making a plastic food bag for carryout food particularly for hot carryout food most preferably for barbecued or rotisserie chicken is provided. Desirably the bag is assembled through the use of a bag making machine with heat sealing capability. Desirably the number of heat sealing operations can be limited in manufacturing the bag. Desirably the plastic for the panels used to assemble the bag is supplied on rolls of plastic film. Preferably three (3) rolls of plastic film and a closure assembly roll are desirably used in the assembly of a bag according to the invention. Preferably, the first and third rolls are PE on one side laminated to OPP. Thus, one side of the plastic is PE and the opposite side is OPP. Preferably the second roll has CCP outer layers with a nylon layer in between. The three (3) layers are laminated together to form the second roll of plastic film. The first roll is used to provide the front and back panels. The second roll is used to provide the floor or gusset panel. The third roll provides the upper panel. A fourth roll which contains the track assembly is also provided. FIG. 7 shows the position of components just prior to heat sealing.

Initially, a section of the first roll is cut as a single piece to provide the front and back panels. The material then is further cut to provide the individual front 14 and back 12 panels. The floor panel is then cut from the second roll folded to form a gusset 26 and slipped between the front 14 and back 12 panels adjacent the bottom of the panels. The front panel 14 is shorter than the back panel 12. The polyethylene (PE) sides of the front and back panel are arranged so they face one another with the floor or gusset material in between. Desirably the front and back panel material facing one another is heat sealable together which will be described in greater detail below. The upper panel 16 is then cut from the third roll and slid between the front 14 and back 12 panel. The upper panel 16 is folded back on itself at the bottom thereof along a fold line 20 to form the flap 18. It is preferred that the side of the upper panel 16 facing the front panel 14 be made of a material that will not heat seal to itself. When the flap 18 is folded from the bottom of the upper panel 16, it is preferred that the material on the back of the flap, that is the part of the flap that is facing the upper panel body is of a material that will not heat seal with the material of the upper panel that faces the front panel. This makes the heat sealing procedure much simpler. It is also desirable that the material of the flap that faces the front panel 14 be of a material that will heat seal with the inside of the front panel. The upper panel facing the back panel desirably is a material preferably a plastic that will heat seal with the back panel. Thus, desirably, the front panel and the back panel on the sides facing the outside of the bag are made of OPP and on the sides facing the inside of the bag are PE. The upper panel is OPP on the side facing the front panel and PE on the opposite side. Thus, the back of the flap will not heat seal to the upper panel body 17 during heat sealing. A track assembly 50 which is preferably polyethylene is then slid into place between the front of the flap and the front panel. Thus the PE side of the upper panel faces the PE side of the back panel. When the upper panel is folded up to form the flap, the side of the flap facing the front panel is PE and the side of the flap facing the upper panel body is OPP. PE and OPP heat seal together. OPP does not heat seal to OPP. PE heat seals to PE.

A heat seal bar is applied to connect the track assembly 50 to the front panel 14 and to the flap 18. At the same time, seal strip 36 is formed connecting the upper panel to the back panel across the width of the bag. The flap 18 itself is not heat sealed to the upper panel body 17 since both are OPP layers facing one another and do not heat seal together. The left and right sides of the bag are then contacted to a heat sealing bar. The sides of the flap are heat sealed to the sides of the front panel. The sides of the front and back panel are heat sealed together. The sides of the upper panel body are heat sealed to the back panel. However, the sides of the flap are not sealed to the back panel. The back of the flap is OPP and the upper panel body facing the flap is OPP. Thus, there is no heat sealing at the sides. By not heat sealing the flap to the back of the bag, the opening 44 is larger and thus can be more easily loaded with food.

The bottom of the bag is formed by heat sealing the gusset to the front and back of the bag. Handles are then punched in the upper panel and back panel for the bag. Optionally, the panel can be prepunched with handles. Finally, the slider 34 is added to the track to open and close the bag. As a result, the bag components are efficiently heat sealed together. There is one application of the heat sealing bar to seal the track assembly to the flap and to the front panel as well as forming the seal strip 36. There is one application of the sealing bar to seal to the left side and then to the right side to form the side seals. Finally, the heat sealing bar is applied to the gusset to connect the floor to the front and back panels. The slider 34 is then added to the bag to open and close the bag.

The resulting bag has an opening extending substantially the entire width of said bag. The resulting bag can be quickly loaded without soiling the top of the bag which folds away from the opening. The handles are formed in separate bag panels. This results in a stronger handle structure. As a result one handle can fail without compromising the integrity of the bag. Since the handles are attached to different panels than the closure system, any ripping of the top at the handles will not affect the seal. The seal strip separates the handles structurally from the rest of the bag. Any ripping in the top of the bag would likely not migrate to the bag below the seal strip. As a result, the bag will remain sealed despite handle failure.

The foregoing is considered as illustrative only to the principles of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A plastic bag for carryout food comprising;

a) a back panel, said back panel having a top and bottom said back panel having a handle opening therein;

b) a front panel having a top and bottom;

c) a floor panel connecting said front panel and said back panel at the bottom of said front and back panel to form a bag floor;

d) said front panel terminating below said back panel handle;

e) an upper panel having a top and bottom; said top of said upper panel having a handle opening; said upper panel having an upper panel body and a flap extending from the bottom of said upper panel body;

f) said flap extending upwardly a preselected distance from the bottom of said upper panel body to at least partially overlap said upper panel body at the bottom thereof;

g) said upper panel body heat sealed to said back panel below said back panel handle opening and said upper panel handle opening to form a horizontal seal strip across the width of the bag prior to filling said bag; said back panel handle opening in substantial alignment with said upper panel handle opening;

h) said front panel and said back panel heat sealed together at the sides thereof, said upper panel body heat sealed to said back panel at the sides thereof, and said flap heat sealed to said front panel at the sides thereof said flap unconnected at the sides thereof to said back panel to form said bag having a single opening to allow loading and removal of a food product therein; said bag fully formed prior to the loading of said bag; said single opening centrally located in said bag;

i) an interlocking closure; said closure having a first track and a second track that interlocks with said first track;

j) said first track heat sealed to the outside of said flap;

k) said second track heat sealed to the inside of said front panel so that when said tracks are engaged, said central opening is sealed when said tracks are disengaged, said central opening is unsealed;

l) said handles spaced apart from said single opening.

2. A plastic bag for carryout food according to claim 1 wherein said handles extend downward away form said single opening to avoid contamination of said handles during food loading of said bag.

3. A plastic bag for carryout food according to claim 2 wherein said handle extends below said horizontal seal strip behind said back panel during loading.

4. A plastic bag for carryout food according to claim 1 wherein said handle openings are both located on the same side of said opening.

5. A plastic bag for carryout food according to claim 1 wherein said tracks are zipper tracks which are engaged and disengaged by a slider.

6. A plastic bag for carryout food according to claim 1 wherein said floor panel is a gusset heat sealed to said front and said back panels.

7. A plastic bag for carryout food according to claim 1 wherein said central opening extends substantially the entire width of said bag.

8. A plastic bag for carryout food according to claim 1 wherein said upper panel has a front facing said front panel and a back facing the back panel, said upper panel front is a plastic that not heat sealable to itself so that said flap does not heat seal to said upper panel body.

9. A plastic bag for carryout food according to claim 8 wherein said upper panel back is a plastic that is heat sealable to said to said front panel and said back panel.

10. A plastic bag for carryout food according to claim 9 wherein said upper panel front is oriented polypropylene.

11. A plastic bag for carryout food according to claim 10 wherein said upper panel back is polyethylene.

12. A plastic bag for carryout food according to claim 11 wherein said upper panel back and said upper panel front are laminated together.

13. A plastic bag for carryout food according to claim 1 wherein said handles are spaced apart from said single opening by the length of said upper panel between the handle and the first track.

14. A plastic bag for carryout food according to claim 1 further comprising a cooked chicken loaded in said bag.

* * * * *